US008835786B2

(12) United States Patent
Hofmann et al.

(10) Patent No.: US 8,835,786 B2
(45) Date of Patent: Sep. 16, 2014

(54) ACTUATING DEVICE FOR A POWER SWITCH

(75) Inventors: Michael Hofmann, Rieden (DE); Harald Spittler, Markt Erlbach (DE)

(73) Assignee: Siemens Aktiengesellschaft, Munich (DE)

( * ) Notice: Subject to any disclaimer, the term of this patent is extended or adjusted under 35 U.S.C. 154(b) by 233 days.

(21) Appl. No.: 13/505,629

(22) PCT Filed: Oct. 12, 2010

(86) PCT No.: PCT/EP2010/065265

§ 371 (c)(1),
(2), (4) Date: Jun. 26, 2012

(87) PCT Pub. No.: WO2011/054629

PCT Pub. Date: May 12, 2011

(65) Prior Publication Data

US 2013/0001057 A1 Jan. 3, 2013

(30) Foreign Application Priority Data

Nov. 3, 2009 (DE) ..... 10 2009 053 163

(51) Int. Cl.
*H01H 5/06* (2006.01)
*H01H 71/70* (2006.01)

(52) U.S. Cl.
CPC ..... *H01H 71/70* (2013.01)
USPC ..... 200/400

(58) Field of Classification Search
USPC ..... 200/400; 335/76, 171
IPC ..... H01H 3/30,3/301, 3/3026, 3/3031
See application file for complete search history.

(56) References Cited

U.S. PATENT DOCUMENTS

| | | | | |
|---|---|---|---|---|
| 3,097,275 | A | 7/1963 | Wiktor | |
| 3,289,790 | A | 12/1966 | Ivins | |
| 3,794,792 | A * | 2/1974 | Wilson | 200/400 |
| 5,004,875 | A | 4/1991 | Bell et al. | |
| 5,180,051 | A * | 1/1993 | Cook et al. | 200/400 |
| 5,323,131 | A | 6/1994 | Castonguay | |
| 5,408,208 | A * | 4/1995 | DiMarco et al. | 335/14 |
| 5,929,405 | A | 7/1999 | Doran | |
| 6,940,032 | B2 * | 9/2005 | Sirajtheen et al. | 200/400 |

FOREIGN PATENT DOCUMENTS

| | | | |
|---|---|---|---|
| CN | 2396498 | Y | 9/2000 |
| CN | 2775815 | Y | 4/2006 |
| DE | 3048317 | A1 | 7/1982 |
| DE | 29906480 | U1 | 9/1999 |
| EP | 1163689 | A1 | 12/2001 |

OTHER PUBLICATIONS

German Priority Document DE 10 2009 053 163.7.
German Search Report.
International Search Report.

* cited by examiner

*Primary Examiner* — Vanessa Girardi
(74) *Attorney, Agent, or Firm* — Harness, Dickey & Pierce

(57) ABSTRACT

A switch includes a handle for activation and deactivation and an actuating device. The actuating device includes a motor drive, which tensions a spring held in a tensioned state by latching by way of a gear. Two spring pairs are provided for activation and deactivation. The two bridges are arranged, with the spring pairs thereof nested within each other and displaceable with respect to each other. The bridges facing each other are pressed apart from one another to tension the spring pairs, and an actuation element is arranged on the one bridge for activation and an actuation element is arranged on the other bridge for deactivation.

14 Claims, 3 Drawing Sheets

ACTUATING DEVICE FOR A POWER SWITCH

PRIORITY STATEMENT

This application is the national phase under 35 U.S.C. §371 of PCT International Application No. PCT/EP2010/065265 which has an International filing date of Oct. 12, 2010, which designated the United States of America, and which claims priority to German patent application number DE 10 2009 053 163.7 filed Nov. 3, 2009, the entire contents of each of which are hereby incorporated herein by reference.

FIELD

At least one example embodiment of the inventive concepts generally relates to a switch, in particular a power switch for low voltages.

BACKGROUND

Switches embodied as compact power switches for low voltages are known and have a rocker lever as an actuator for turning the switch on and off. To enable it to be turned off also by remote control, the switch is furnished with an actuating device that has a remotely controllable motor drive having a spring pair. The actuating device is therein mounted on the switch such that the rocker lever can be thrown by way of an actuating element that is moved accordingly when a pre-tensioned spring is released. The necessary force is supplied by the releasing of the tensioned spring. The motor drive serves to tension the spring, doing so by way of a gear that has a downstream mechanical system and holding it in its tensioned state via a latch. Motor drives of such kind mounted on the switch are referred to also as stored-energy spring mechanisms.

SUMMARY

At least one example embodiment of the inventice concepts provides that the switch is capable of being turned on again relatively quickly after being turned off.

The subclaims constitute advantageous embodiments.

An example embodiment provides two spring pairs, one pair for turning on the switch and the other for turning off the switch. Each of the two spring pairs are connected to each other via a bridge. The spring pairs are supported in each case on the sides of the bridges facing away from each other. The two bridges are arranged displaceably relative to each other with their spring pairs nested one inside the other. The mutually facing bridges are pushed apart to tension the spring pairs. An actuating element for turning on the switch being arranged on one bridge and an actuating element for turning off the switch being arranged on the other. The solution is therefore based on the idea of using two spring pairs that are tensioned simultaneously by a motor drive, with the two latchable spring pairs (sets of springs) being able to be unlatched mutually independently. One of the two spring pairs is therein provided for turning on the switch and the other for turning off the switch.

BRIEF DESCRIPTION OF THE DRAWINGS

Example embodiments of the inventive concepts are described in more detail below with the aid of drawings, in which.

DETAILED DESCRIPTION OF THE EXAMPLE EMBODIMENTS

An example embodiment provides for two spring pairs to be provided, one pair for turning on a switch and the other for turning off the switch. Each of the two spring pairs are connected to each other via a bridge. The spring pairs are supported on the sides of the bridges facing away from each other. The two bridges are arranged displaceably relative to each other with their spring pairs nested one inside the other. The mutually facing bridges are pushed apart to tension the spring pairs. An actuating element for turning on the switch is arranged on one bridge and an actuating element for turning off the switch is arranged on the other. The solution is therefore based on the idea of using two spring pairs that are tensioned simultaneously by a motor drive, with the two latchable spring pairs (sets of springs) being able to be unlatched mutually independently. One of the two spring pairs is therein provided for turning on the switch and the other for turning off the switch.

A technically simple example embodiment provides for the bridges to be pushed apart for tensioning the spring pairs by way of a mechanical system formed from two levers.

Simultaneously pushing the two bridges apart can be achieved if the two levers are pushed apart by a strain washer having on both sides one driver, on each of which one of the levers rests.

It is proposed for the two drivers to be pivotably mounted to keep the counterforces small when the two spring pairs are being tensioned.

A particularly compact example embodiment will result from arranging the spring pairs as nested one inside the other.

Emergency shut-off in the event of a power outage will also be ensured if the spring pair for turning on the switch has a smaller spring constant than the spring pair for turning off the switch, such that, particularly by hand, the turned-on switch can be turned off in each case with the aid of the turn-off spring pair but the turned-off switch cannot be turned on again by way of the turn-on spring pair. Thus the sets of springs are arranged such that the power switch can undergo (EMERGENCY) shut-off at any time.

It is technically simple for the actuating elements to be embodied as edges on the bridges.

Figure 1:
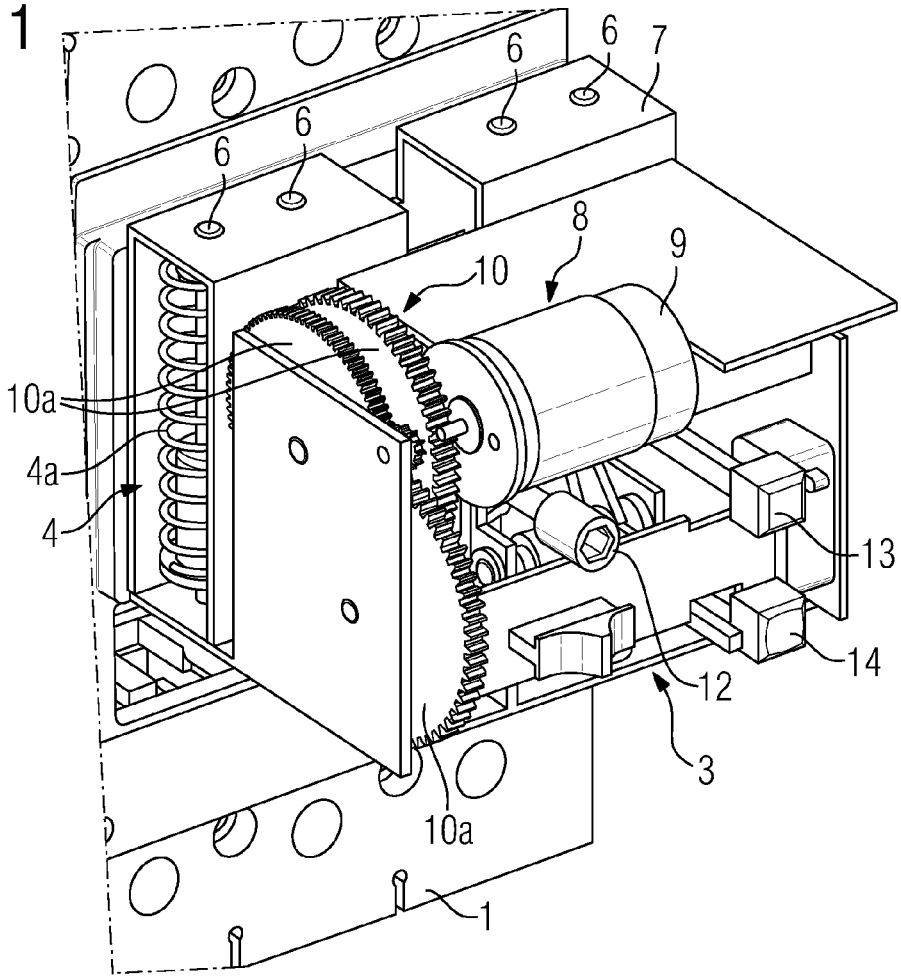
FIG. 1 shows a switch having an actuating device for remotely controlled turning on and off.

FIG. 1 shows a known switch 1 designed as a power switch for low voltages utilizing the actuating device described herein, according to one example embodiment. For turning the switch on and off, switch 1 has an actuator 2 in the form of a rocker lever 2*a* (see FIGS. 3 and 4). Rocker lever 2*a* is here thrown by way of an actuating device 3 mounted on the front side of switch 1. Actuating device 3 has a spring pair 4 and a spring pair 5 for turning on and off (see FIGS. 3 and 4); of spring pair 4, only a helical spring 4*a* which is in its released state can be seen in FIG. 1. Spring pairs 4, 5 can be tensioned along guides 6 and are located in a frame 7. Tensioning is performed by a motor drive 8 having a motor 9, a gear train 10 that has gear wheels 10*a*, and tensioning device 11 (see FIG.

2). Via a charging shaft 12 the two spring pairs 4, 5 can also be tensioned manually by way of a screw drive. An OFF pushbutton 13 will enable an operator to turn switch 1 off manually when spring pair 4 is tensioned and an ON pushbutton 14 to turn switch 1 on.

An electronic circuit (not shown) ensures that the two spring pairs 4, 5 are tensioned by motor drive 8 under remote control by way of electric control signals and that switch 1 can be turned on and also off again.

Figure 2:
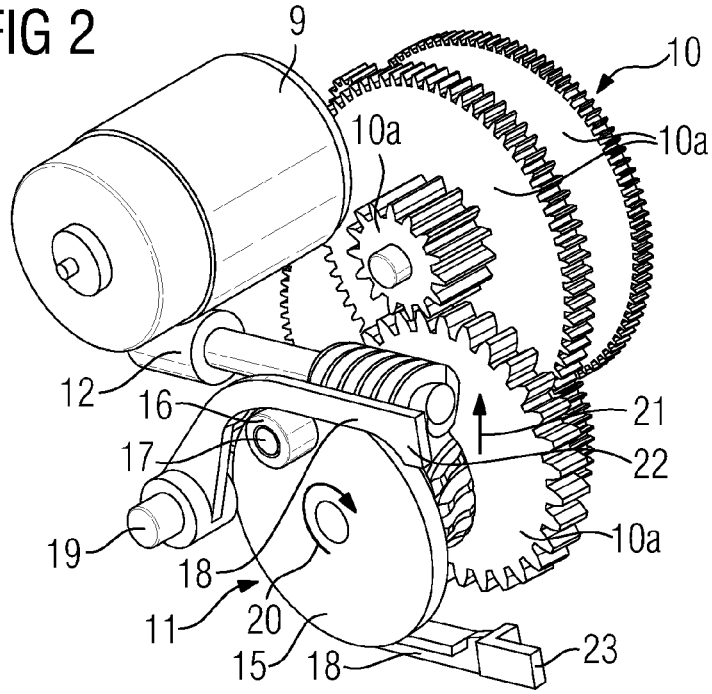
FIG. 2 shows the motor drive of the actuating device shown in FIG. 1.

FIG. 2 only shows motor drive 8 that drives strain washer 15 via motor 9 and gear 10. Strain washer 15 has drivers 16, one on each flat side, that are mutually opposite and each pivotably mounted on an axle 17 via a needle bearing. Resting on the outside of cylindrical drivers 16 is in each case the inside of one of two outwardly bent levers 18 that are pivotably mounted on a common axle 19. The two levers 18 will simultaneously be pushed away from each other when strain washer 15 moves in the direction of arrow 20. Arrow 21 indicates the direction of motion of free end 22 of upper lever 18 in FIG. 2; free end 23 of lower lever 18 then simultaneously moves downward in the opposite direction.

Figure 3:
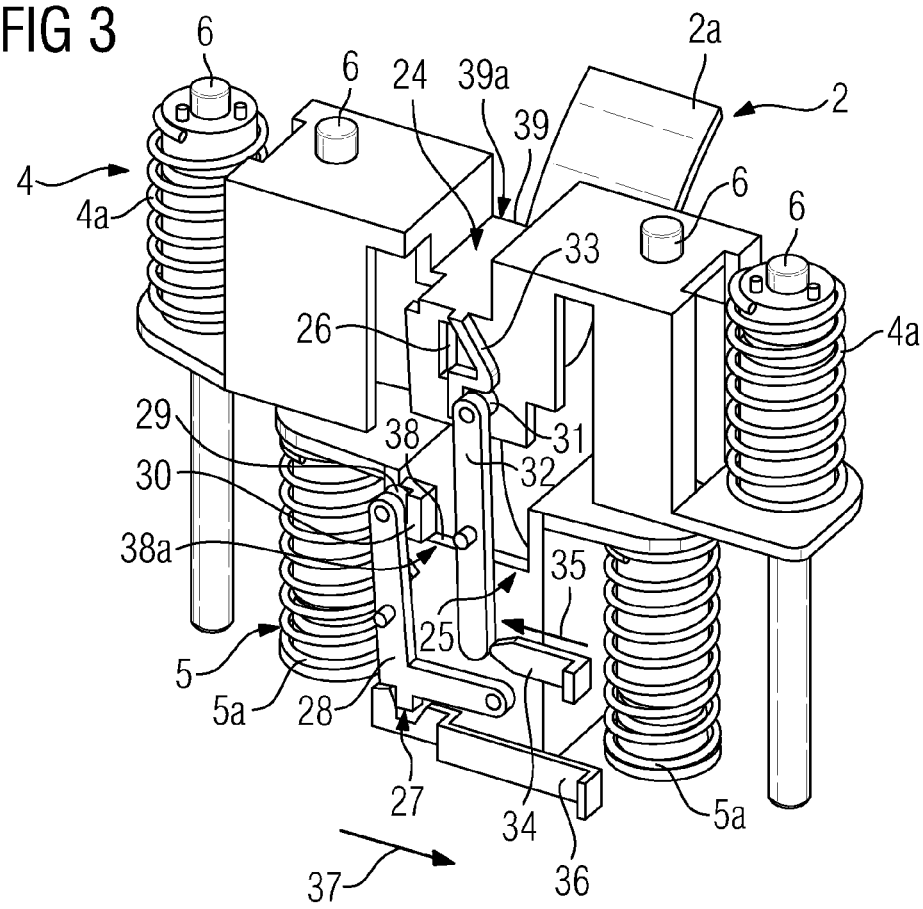
FIG. 3 shows the actuating device shown in FIG. 1 having tensioned spring pairs without a frame.

Shown in FIG. 3 are the two spring pairs 4, 5 in their tensioned state without frame 7, with levers 18 having both been omitted for the sake of clarity. Springs 4*a*, 5*a* of the two spring pairs 4, 5 are in each case connected to each other via a bridge 24, 25. Free end 22 of (upper) lever 18 therein engages into a receiving opening 26 of bridge 24. Receiving opening 27 for free end 23 of (lower) lever 18 is not visible in FIG. 3; it is located behind and obscured by an angle lever 28. Upper end 29 of angle lever 28 is engaged in position in a sliding block guide 30, as a result of which spring pair 5 is latched. End 31 of a double lever 32 is analogously engaged in position with a sliding block guide 33 of bridge 24 and spring pair 4 latched in that way. As shown in FIG. 3, spring pairs 4, 5 are supported in each case on the sides facing away from each other of bridges 24, 25. Both bridges 24, 25 can move unimpeded along guides 6, meaning they are arranged displaceably relative to each other, here nested one inside the other. It could of course also be provided for both to move past each other.

Pressure will cause a slide 34 to move in the direction of arrow 35 against the lower end of double lever 32 and upper bridge 24 with springs 5*a* to unlatch so that bridge 24 as shown in FIG. 3 will move downward and push projecting rocker lever 2*a* downward into its OFF position. A tensile force upon slide 36 in the direction of arrow 37 results independently thereof in unlatching of lower bridge 25 which then moves upward and pushes rocker lever 2*a* upward into its ON position by way of edge 38. Edge 38 acts here as an actuating element 38*a*; edge 39 on bridge 24 is its actuating element 39*a*.

Figure 4:
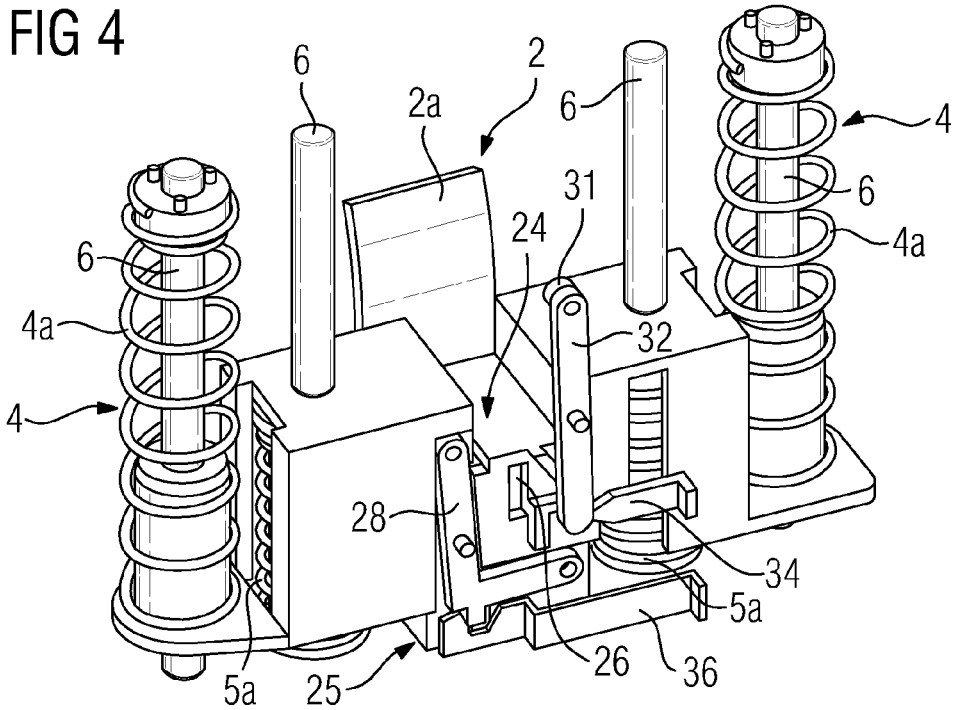
FIG. 4 shows the actuating device shown in FIG. 1 after the switch has been turned off.

Shown in FIG. 4 is actuating device 3 after bridge 24 and hence spring pair 4 have been unlatched for turning switch 1 off. Switch 1 has been turned off and spring pair 5 is in the tensioned state. So switch 1 could actually be turned on again straight away.

The spring constants of springs 4*a*, 5*a* are different in magnitude, with the difference being selected such that switch 1 cannot ever be turned on unless turn-off spring pair 4 is in the tensioned state. Turn-on spring pair 5 therefore has a smaller spring constant than turn-off spring pair 4 so that although turned-on switch 1 can be turned off with the aid of turn-off spring pair 4, turned-off switch 1 cannot be turned on again by way of turn-on spring pair 5. Actuating device 3 in FIG. 4 cannot initially be turned on again in the state shown because springs 4*a* are weaker than springs 5*a*. It can only be turned on again once both spring pairs 4, 5 have been retensioned.

Switch 1 can be turned off at any time even with no operating voltage because the force of turn-off spring pair 4 is sufficiently strong to overcome the counterforce of set of springs 5 during turning off.

Figure 5:
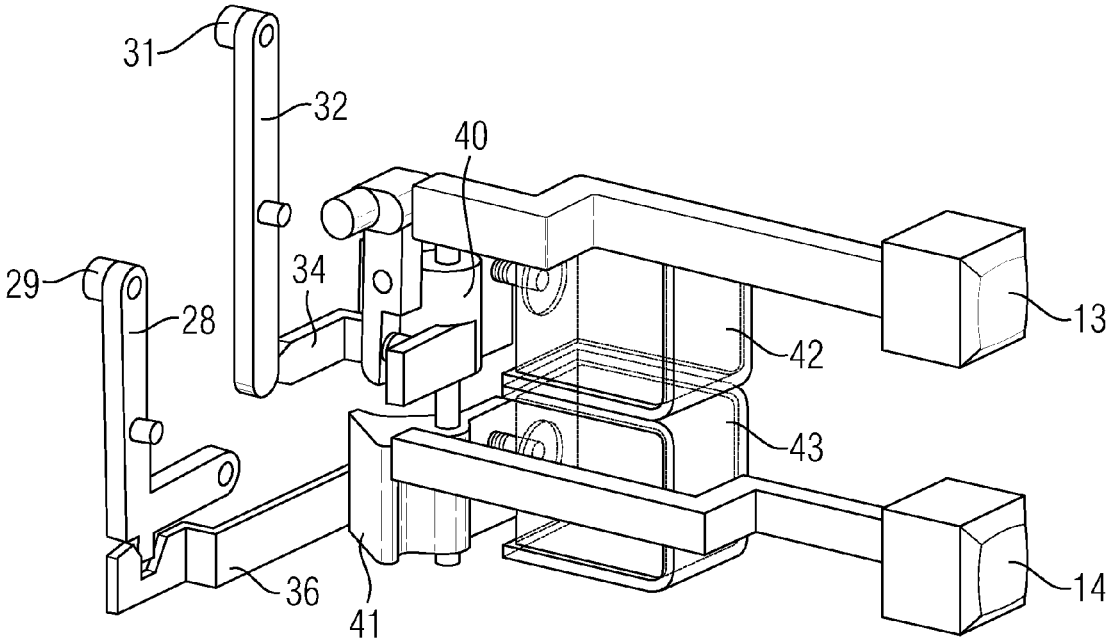
FIG. 5 shows how the ON and OFF pushbuttons are coupled.

FIG. 5 shows the mechanical connection between OFF pushbutton 13, slide 34, and double lever 32 and also between ON pushbutton 14, slide 36, and angle lever 28. OFF pushbutton 13 mechanically actuated by an operator pushes slide 34 via a swivel element 40 against double lever 32 which unlatches upper bridge 24 with springs 5*a*, which bridge moves rocker lever 2*a* downward into its OFF position. That will therefore enable an operator to turn switch 1 off by hand with spring pair 4 in the tensioned state.

ON pushbutton 14 analogously causes slide 36 to be pulled to the right via a swivel element 41, the result of which is pivoting of angle lever 28 which unlatches lower bridge 25, with springs 4*a*, which moves rocker lever 2*a* upward into its ON position.

Swivel elements 40 and 41, when remote control is employed, will be swiveled by electromagnetic devices 42, 43 that will turn switch 1 on or, as the case may be, off.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A switch, comprising:

an actuator configured to turn the switch on and off;

an actuating device, located on an actuator side on the switch, configured to at least turn the switch on, the actuating device including a motor drive configured to, by way of a gear that actuates a mechanical system, tension at least one spring held in the tensioned state and being capable of unlatching to actuate the actuator, and the actuator being capable of being swiveled by the at least one spring as the at least one spring is released from the tensioned state;

two spring pairs, one of the two spring pairs configured to turn on the switch and the other of the two spring pairs configured to turn off the switch, each of the two spring pairs being connected via a bridge and each of the two spring pairs further being supported on a respective side of the respective bridge facing away from each other, the two bridges being arranged displaceably relative to each other and the bridges being capable of being pushed apart to tension the spring pairs;

a first actuating element configured to turn the switch on, arranged on one of the two bridges; and and a second actuating element configured to turn the switch off, arranged on the other of the two bridges.

2. The switch as claimed in claim 1, wherein the actuating elements are edges on the bridges.

3. The switch as claimed in claim 1, wherein the actuator is a rocker lever.

4. The switch as claimed in claim 1, wherein the switch is a power switch for low voltages.

5. The switch as claimed in claim 1, wherein the actuating device, located on the actuator side on the switch to at least turn the switch on, is remotely controlled by way of electric control signals.

6. The switch as claimed in claim 1, wherein the spring pairs are nested one inside the other.

7. The switch as claimed in claim 6, wherein the one of the spring pairs configured to turn the switch on includes a relatively smaller spring constant compared to the other one of the spring pairs configured to turn the switch off, such that the turned-on switch can be turned off in each case with the aid of the turn-off spring pair but the turned-off switch cannot be turned on again by way of the turn-on spring pair.

8. The switch as claimed in claim 1, wherein the bridges are pushed apart for tensioning the spring pairs by way of, the mechanical system, and the mechanical system is formed from two levers.

9. The switch as claimed in claim 8, wherein the actuating elements are edges on the bridges.

10. The switch as claimed in claim 8, wherein the actuator is a rocker lever.

11. The switch as claimed in claim 8, further comprising a strain washer configured to push the two levers apart, wherein the strain washer includes a driver on both sides, a lever resting on each respective driver.

12. The switch as claimed in claim 11, wherein the two drivers are pivotably mounted.

13. The switch as claimed in claim 8, wherein the spring pairs are nested one inside the other.

14. The switch as claimed in claim 13, wherein the one of the spring pairs configured to turn the switch on includes a relatively smaller spring constant compared to the other one of the spring pairs configured to turn the switch off, such that the turned-on switch can be turned off in each case with the aid of the turn-off spring pair but the turned-off switch cannot be turned on again by way of the turn-on spring pair.

* * * * *